United States Patent [19]

Meckler

[11] 4,325,654

[45] Apr. 20, 1982

[54] COLUMN SUPPORTED PLATFORM AND LIFT WITH PRESTRESSED DAMPING SYSTEM

[76] Inventor: Milton Meckler, 16348 Tupper St., Sepulveda, Calif. 91348

[21] Appl. No.: 92,174

[22] Filed: Nov. 7, 1979

[51] Int. Cl.[3] ..... E02B 17/04

[52] U.S. Cl. ..... 405/196; 52/167

[58] Field of Search ..... 405/195, 196, 197, 198, 405/199, 200, 211; 52/167

[56] References Cited

U.S. PATENT DOCUMENTS 3,538,653 11/1970 Meckler ..... 52/167 X 3,796,017 3/1974 Meckler ..... 52/167 X 3,986,368 10/1976 Levingston ..... 405/196

*Primary Examiner*—David H. Corbin

*Attorney, Agent, or Firm*—William H. Maxwell

[57] ABSTRACT

A self erecting prefabricated structure comprised of erected columns and platforms and independently supported masses, with structural members operating primarily in tension and characterized by a composite of prestressed multitube form with internal hydraulic pressure controlled by translator means responding to static and dynamic loads applied and transfering the same into secondary members to compensate for said load and to damp oscillation as said load is applied and released.

31 Claims, 16 Drawing Figures

(TRUSSES NOT SHOWN)

COLUMN SUPPORTED PLATFORM AND LIFT WITH PRESTRESSED DAMPING SYSTEM

BACKGROUND

The prefabrication, erection, maintenance and dismantling of working structures such as off-shore, and on-land workover oil drilling and exploration platforms, as well as the erection of permanent multi-floor buildings and other engineered structures have problems in common. It is an object of this invention to preserve both new and existant building structures and like frameworks, through the application of tension applied through hydraulic translation. Fabrication is of course primary, while life expectancy of the structure is commensurate with the subjection to external forces that have deteriorating effects. Transport of structural members to the erection or building site in a disassembled condition is advantageous, and adverse conditions are expected to be encountered at the site. Not only are there irregularities in the geological formations relied upon for foundation support, but there are irratic dynamic forces applied in the form of wind and ocean waves, and shifting earth formations as well. The steady application of external forces is one factor to be accounted for, and the frequency of wave application of forces is a second factor to be accounted for. An object therefore, is the partial or complete absorbtion of energy entering the structure by means of controlled hydraulic damping.

A characteristic of any structure is its mass inertia and inherent resonant frequency, to be considered with respect to the frequency of externally applied wave motion forces. Rigid structures, although to an extent resilient, eventually fail as they are continuously subjected to stresses and strains that result in fatigue. It is the flexure and bending of columns and trusses under load condition, members that are rigidly interconnected and eventually fail when repeated cycles of force applications cause fatigue at the critical points of joinder. Collapse is an eventuality. Accordingly, it is a general object of this invention to provide means by which structures comprised of floors and platforms are erected and dismantled at their sites, and utilizing internally pre-stressed tubular members under hydraulic pressure that is translated to support said floors and platforms under tension loading, all of which is flexible as distinguished from rigid and therefore not as readily subject to fatigue and subsequent failure.

Reference is made to U.S. Pat. No. 3,438,653 issued to the inventor herein on Nov. 10, 1970, entitled Hydraulic Structural Apparatus, wherein "translators" are disclosed for the purpose of hydraulically translating fluid pressure (by means of fluid transfer) created by the support of a floor slab and/or lateral thrusts to the interior of liquid column elements and structural columns in combination therewith. Said liquid column elements are embodied in multiple tubular members which are placed in tension through circumferential and axial prestress by the application of internal hydraulic pressure. These multiple tubular members are constrained within an envelope member, as a bundle of slender thin walled tubes, used as both primary support columns and as secondary tension members, with pressure equilibrium of the fluid within the columns determined by the said hydraulic translators used to restrain column end conditions. It is an object of this invention to advantageously employ the aforesaid prestressed multi tube structural members, for their high load capabilities and flexible properties independant of the floor or platform supported thereby.

The raising of prefabricated floors and platforms has been proposed and practiced in various forms, invariably however with their rigid interconnections to the supporting columns. On the contrary, it is an object herein to isolate and separate the mass of the platform from its supporting column and associated diagonal and/or horizontal bracing, and to this end I provide a suspension lift means carried from the head of the prestressed column. A feature or said lift means is its support by means of pressure translation at the head of the column, the support function thereof being independent of the lifting and lowering functions as later described.

The suspension lift means takes several forms as it is disclosed therein. A characteristic feature is the stepped-spool configuration of the secondary tensioned support members, providing a series of controlled sequenced elevations for floor and platform support. Another feature is the cable tension core of said secondary support member, the spools being arranged therealong and each swaged so as to be immovable therewith. Further, hydraulically operable slip-clamps are employed to disengageably rest upon the spools which provide incrementally elevated steps therefor. In its simplest form the lift means is single acting to incrementally raise the floor, permitting it to be lowered by gravity. However, in the form shown the lift means is double acting to drive the platform both upwardly and downwardly.

Buildings, and particularly high-rise structures and similarly on-land or on-shore workover and off-shore rigs for the exploration and production of oil are subjected to vibrations as a result of severe wind loads, and the latter to the hydraulic action of the seas. These are exterior forces that are applied on a continuing basis with fluctuations ever present in complex wave form, also applied as impact forces at times. Reference is made to relatively constant wind and ocean wave motions on the one hand, and to seismic movements of the earth and tidal waves on the other hand. As external force in various forms of wave energy are applied to building structures, increased and reduced loads are applied to interrelated members, with detrimental stress increases. With the multi-tube hydraulic tensioned support employed herein such loads are taken into the heavily loaded hydraulic columns and translated through controlling orifices to secondary members, to restrain oscillation when the initial load application is released. It is an object therefore to hydraulically damp the prestressed structure, so as to absorb high energy external force application and to dissipate the same when the initial force is released.

SUMMARY OF INVENTION

This invention relates to the construction of buildings and floored structures wherein prestressed columns are employed to reduce mass and to increase load carrying capacity. Multi tubular thin-walled column members are employed and subjected to high internally applied hydraulic pressure. This pressure applies hoop stress that slightly increases the diameter and length of the tubes, the pressure being controlled by translator means at the ends of the tubes, by which means the the prestress is made proportional to the static and dynamic platform load and responsive to external force application as will be described. The translator means converts the stress force into a supporting pressure that is applied to suspension lift means in the form of a tensioned rod comprised of stepped spools positioning the platform at incremental levels. It is to be understood that a number of floors are to be supported by a common tension member, although the simplified preferred form is shown as an off-shore rig comprised of upper and lower platforms. A characteristic feature of the present invention is the slender and flexible high-rise nature of the composite columns of multi prestressed tubes. Another feature is the suspended support of the platform from pressure translator means whereby prestress is commensurate with load. The upper platform is shown as a floating vessel for transport of the undercarriage comprised of one or more lower platforms, two lower platforms being shown in FIG. 1. The platforms are flexibly coupled to the translators for support, and the translator pressure is transferred to tensioned secondary members which operate in concert with the external forces applied to damp excessive sway of the structure through the application of counteracting forces to the columns commensurate with the increased loads applied.

The foregoing and other various objects and features of this invention will be apparent and fully understood from the following detailed description of typical preferred forms and applications thereof, throughout which description reference is made to the accompanying drawings.

Figure 16:
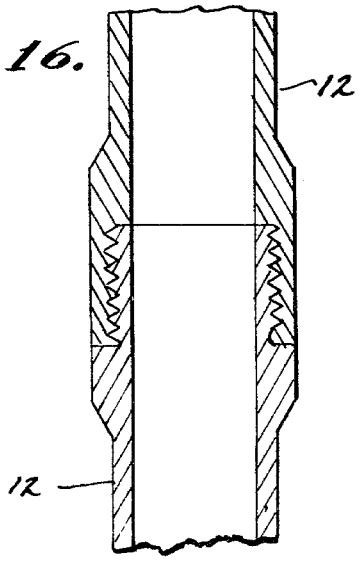

And, FIG. 16 is a fragmentary cross section showing the coupling of primary column sections.

PREFERRED EMBODIMENT

The structure shown is an off-shore rig or oil well drilling platform embodying the features of the present invention, these features being applicable to all such structures and the like having floors and which are to be erected permanently or for subsequent dismantling, as may be required. Whether it is the involvement of floors of buildings or the platforms of off-shore rigs, it is the flexible high rising composite prestressed columns which characterize the present invention. The flexible elongated nature of these highrise composite columns makes for the practicality of the bottom supported rig herein disclosed, subject to the forces of the wind and sea, with means translating said applied forces into hydraulic pressures transferred from secondary structural members associated with each column to compensate against said applied loads and to damp oscillations that otherwise would be caused thereby. Accordingly, there is a separation of interrelated masses the platforms being flexibly suspended from the columns, in each instance with the hydraulic prestress bias by means of pressure modulated through translator means controlling column pressure and transfering the same so as to compensate for stresses as external force is applied to counteract sway, and to return to equilibrium with a damping action.

Figure 1:
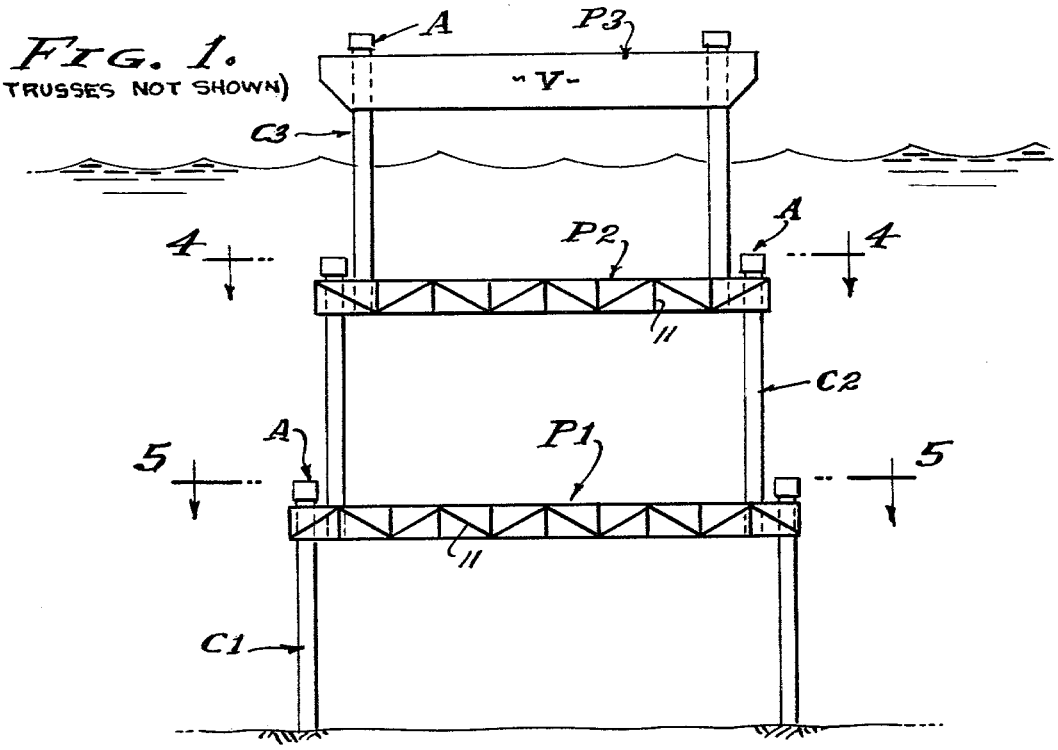
FIG. 1 is a side elevation of an off-shore platform embodying the prestressed features of the present invention.
Figure 2:
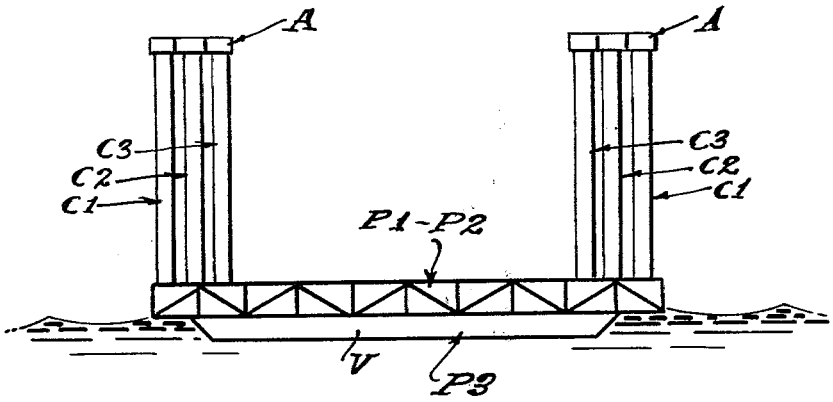
FIG. 2 is a side view of the off-shore platform of FIG. 1 and shown in its retracted mobile condition.

Referring now to FIG. 1 of the drawings and to the mobile exploration platform embodiment as it is disclosed herein, there is an upper floating platform P3 and a plurality of lower platforms P1 and P2. In this case, there is at least one lower platform suspended from the upper platform and adapted to support said upper platform by means of primary and secondary members characterized by pre-stressed multi-tube columns. It is contemplated that the employment of one platform is feasible, in which case trusses are used as described herein to stabilize the primary column means. The suspension-support relationship of successive platforms is the same in each instance, and therefore a description of one will suffice for all. For example, the lowermost platform P1 is the foundation platform with ground engageable columns C1 for support of the entire structure, the intermediate platform or platforms P2 rise to the height of columns C2 in each instance, and the platform P3 is the workover platform which in this case is the vessel V for mobility and transport of the rig as it is shown in FIG. 2 with the platforms retracted together in their transport condition.

Figures 8, 9, 10, 11:
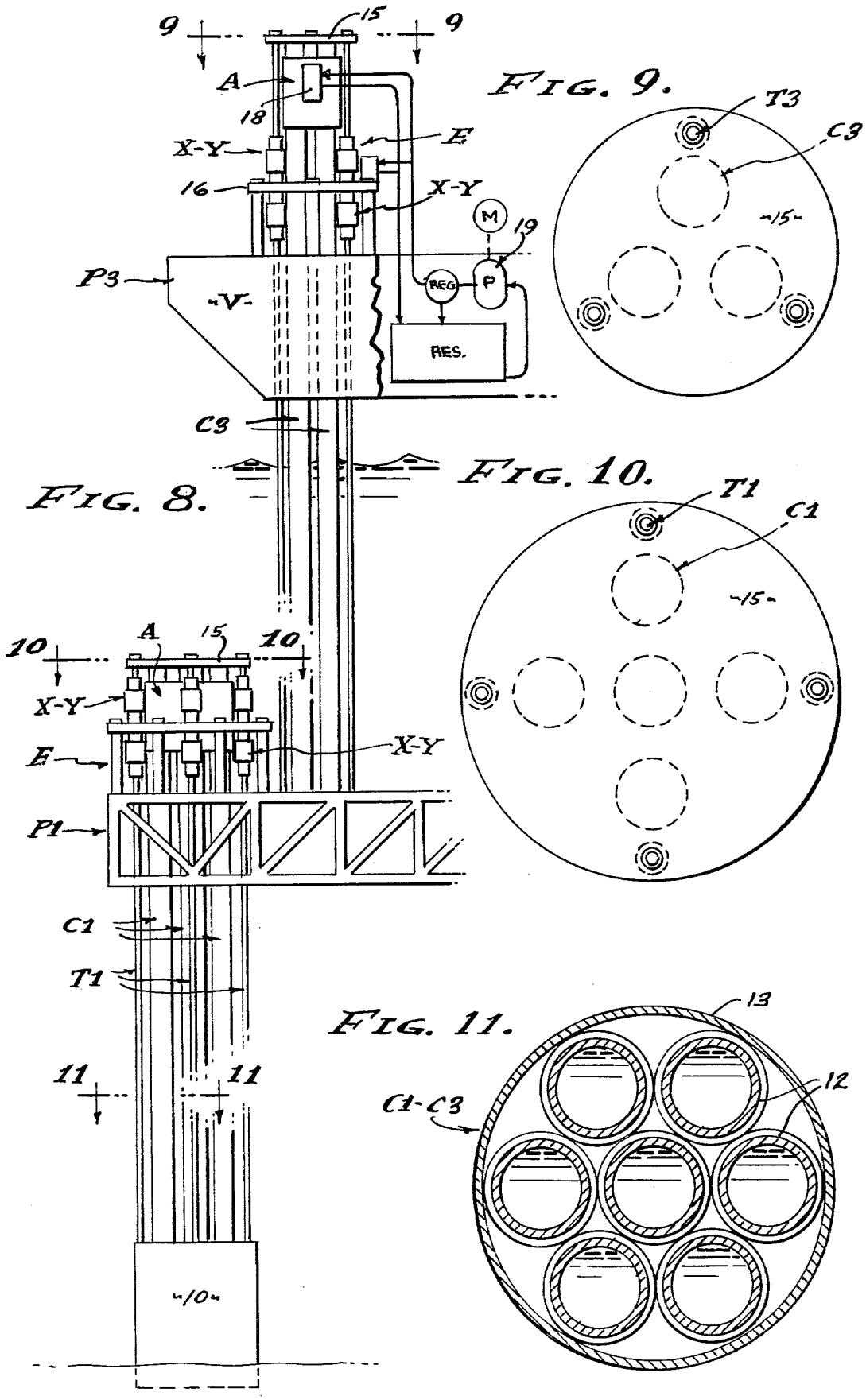
FIG. 8 is an enlarged elevation taken of associated columns and related means at one end of the off-shore platform (two platforms only).
FIGS. 9,10 and 11 are enlarged plan-sections taken as indicated by lines 9—9, 10—10 and 11—11 on FIG. 8.

Referring now to FIG. 8 of the drawings, the self erection of an exploration platform is shown as it is comprised of a foundation platform P1 and a workover platform P3. Again, the columns are essentially alike and differ only in their load carrying capacity as it is determined by the multiple use of the primary composite prestressed columns C1–C3 and the secondary tension members T1–T3. In practice, the lower end portions of columns C1 are fitted with a base or foot 10 in the form of a bouyancy tank that is alternately flooded or emptied of sea water so as to control submersion and/or floatation. The lower platform P1 and platforms P2 are submersed frameworks 11 of truss configuration which remain horizontally disposed and normal to the columns C1–C3. The workover platform P3 is a vessel V of barge configuration providing floatation for the entire structure when the platforms P1–P3 are retracted together as they are shown in FIG. 2.

The columns C1–C3 are characteristically multi tubular legs which comprise the primary column support for a platform from the ground and one from the other. As shown, the base of each primary column is rigid with the platform P1–P3 from which it projects vertically, while the top ends of the primary columns remain free of the platform suspended by the structural members as hereinafter described. The tubular legs are slender elongated cylinders 12 coupled together as shown in FIG. 16 and bundled together and constrained within the confines of a casing 13 also of cylinder form as shown in FIG. 11. A feature is the prestressing of the elongated legs through the application thereto of dynamic internal pressure that varies commensurate with changing structural forces as they are imposed thereon. The aforesaid U.S. Pat. No. 3,538,653 describes a building system concept together with design principles and mechanisms wherein the live and static loads of a building are utilized to provide fluid under pressure which is then used within the system to prestress, strengthen and otherwise redistribute the load forces of the building to other forces of the structure for overall structural efficiency, stability and safety. By means of the disclosure in a subsequent U.S. Pat. No. 3,796,017 issued to the inventor herein on Apr. 24, 1972, entitled Hydraulic Structural Apparatus, fluid pressure is supplied at various points in the structural system and the flow volume pressure and level of that fluid under pressure at any given point in the structural frame is made to depend upon the time varying and static loads upon the building as reacted by the various hydraulic devices and tubular elements of the structure. The live forces are those generated by the wind and wave and seismic motions, and as a result of the movements of equipment, occupants, furniture and the like; whereas the static forces are the architectural loadings upon the building. Said U.S. Pat. No. 3,538,653 describes the general concept, while said U.S. Pat. No. 3,796,017 includes improvements to such a system as well as unique combinations of elements which are useful in such an overall system. In most structural frames for buildings the weight of the columns and walls is generally negligable compared to the weight of the floors, said floor weight being utilized herein to generate fluid under pressure by suspending the floors from a closed volume of fluid whereby increase in the floor loading is transposed to additional pressure or flow by mechanical means in the closed volume system.

In accordance with this invention, a pressure translator means A applies internal hydraulic pressure into the primary column cylinders 12, and into truss cylinders 112, derived from the loading of the secondary tension members T1–T3 responsive to the dynamic applied weight of the platform suspended thereby in each instance. The internal pressure applied to the column and/or truss cylinder or cylinders by the piston 14 of translator means A is commensurate with the dynamic platform loading and acts to strengthen the column legs in direct response to increased leg loading, all in accordance with the disclosures of the aforesaid U.S. Pat. Nos. 3,538,653 and 3,796,017. As shown, a load bearing member or header 15 embraces or surrounds the column leg C1–C3 or cluster thereof comprising the same, the column leg being moveable vertically through a pressure ring 16 or opening in the platform to project from the top and bottom thereof, a determined distance as may be required. The header 15 of means A suspends the platform P1–P3 from the pressure ring 16 thereof through the secondary tension means T1–T3, later described. The platform P1–P3 is in turn coupled to the load bearing header 15 and in accordance with this invention is engaged therewith by elevating means E which suspends the platform from the load bearing member 15 of the translator means A.

The translator means A is provided to apply internal hydraulic pressure to the column 12 responsive to the dynamic weight force of the platform P1–P3. The means A is essentially a cylinder and piston unit or the like, that applies hydraulic fluid to the cylindrical columns 12 and 112 to prestress the same. Accordingly, the effective area of the cylinder and piston thereof is designed to obtain the desired and proportionate pressure of liquid which is then introduced into a manifold chamber 17 at the head of the casing 13, said chamber being open into the multiplicity of tubular columns 12 and/or 112 as shown. Increase and decrease of applied hydraulic pressure variably strengthens the tubular column by changing the prestress thereof in response to dynamic platform load which is modulated by external forces.

Figure 14:
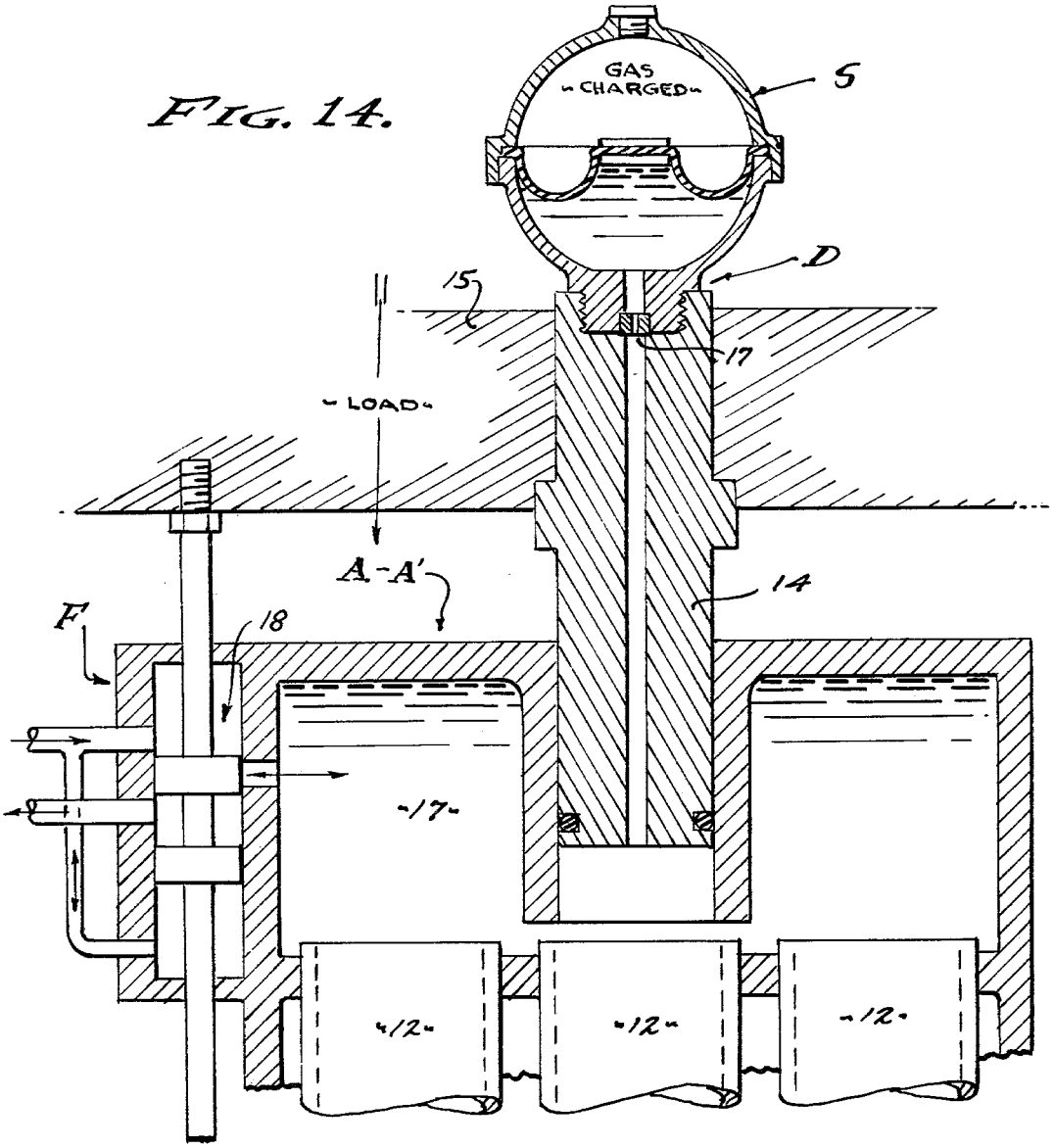
FIG. 14 is a detailed view of the translator means and height control therefor, including hydropneumatic means for absorbing shock and damping motion.
Figure 15:
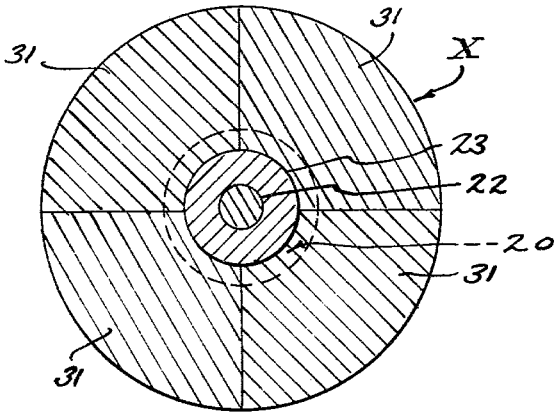
FIG. 15 is an enlarged fragmentary view of the clamp jaws of the elevating means.

Column height or truss length control is by corrector means F that responds to height limits within which the platform P1–P3 is to be disposed and within lateral limits to which the trusses are to be extended. In practice, there is a separate height corrector means F at each column or truss connection, to be set at an elevation, and maintained within high and low limits, or to be set at a lateral limit and maintained within extension limits. As will be observed, the load bearing header 15 and platform P1–P3 suspended therefrom are hydraulically supported and therefore dependant upon the volume of liquid admitted into the system. The high and low limits of elevated position are determined and the means F is provided and adjusted to introduce and exhaust liquid so as to maintain a required volume within the system at all times. Consequently, the platform P1–P3 floats upon the hydraulic liquid by displacing all other fluids (gases) from the system (infinitely compressing entrapped gases), it being understood that hydraulic pressures in the range of 1,000 P.S.I. to 20,000 P.S.I. are employed. As is shown in FIG. 14, the corrector means F comprises a valve, preferably a 3-way pressure balanced spool valve 18 that admits and exhausts into and out of the chamber 17.

In carrying out this invention, there is liquid supply means 19 that operates at delivery pressure in excess of the internal column 12 pressures, the column height corrector valve 18 being linked to vertical movement of the platform P1–P3 as related to the head of the columns C1–C3, so as to sense the existent height thereof. In a low position the valve 18 is opened from the liquid supply means 19 and into the chamber 17; and in the high position is opened to an exhaust line from the chamber 17. At a tolerable intermediate position the valve 18 is closed to both the supply and the exhaust. Accordingly, the column and platform assembly seeks an adjusted position within a predetermined tolerance range. The truss length corrector valve 118 is linked to lateral movement of platform P1–P3 and column C1–C3 assembly as related to the heads of the trusses 112, so as to sense the existent length thereof. In a shortened position the valve 118 is opened from the aforesaid liquid supply 19 and into the manifold chamber in communication with the translator A′ at the head of the truss; and in the extended position is opened to an exhaust line from the manifold chamber. At a tolerable intermediate position the valve 118 is closed to both the supply and the exhaust. Accordingly, the column and platform assembly seeks an adjusted erect position within a predetermined tolerance range.

A feature of the present invention is the cushioning and damping effect incorporated into the translators A and A'. That is, shock loads and inertial changes are controlled. As above described, the volumetric displacement of liquid maintained in the columns and trusses by the corrector means H determines the normal relative position of the structural members comprised of platforms, columns and trusses. However, there are tolerated movements between said structural members and it is these movements which are to be governed; shock by spring means S and inertial changes by damping means D.

The spring means S is a hydro-pneumatic means which advantageously employs the hydraulic character of the translators A and A' wherein the force application is by means of pistons 14 thereof operating in communication with cylinders 12 and 112. Accordingly, the volumetric displacement of column liquid is maintained by corrector means F at a normal pressure commensurate with the load and its variations as applied, said liquid being substantially incompressible. In accordance with this invention, the said pressured liquid is exposed to an elastic medium maintained at said liquid pressure, and in practice by means of a gas accumulator that is precharged and also biased by said liquid pressure. The gas is compressible and depressible from the precharged biased state, and being elastic it operates as a spring. As shown, the accumulator comprises a diaphragm operating in a sphere with hydraulic force applied at the side disposed toward the cylinder 12-112, and with pneumatic force applied at the gas charge side. In the form shown, the accumulated sphere is carried at the exposed end of the piston or ram 14 to move therewith, the gas chamber being supplied with gas under pressure as required; or precharged through a plug or seal.

The damping means D is a hydraulic means which advantageously employs the translator A-A' and spring means S combination, by positioning flow controlling orifice means 17. Accordingly, the load or liquid pressure from column 12-112 is applied against the accumulator piston, ram 14 and diaphram through a restrictive bean or equivalent valve that restricts the flow in one or both directions, thereby controlling accelerations and decelerations in movement. Accordingly, the substantially incompressible liquid support is simultaneously cushioned and tolerated movements thereof damped.

Figure 6:
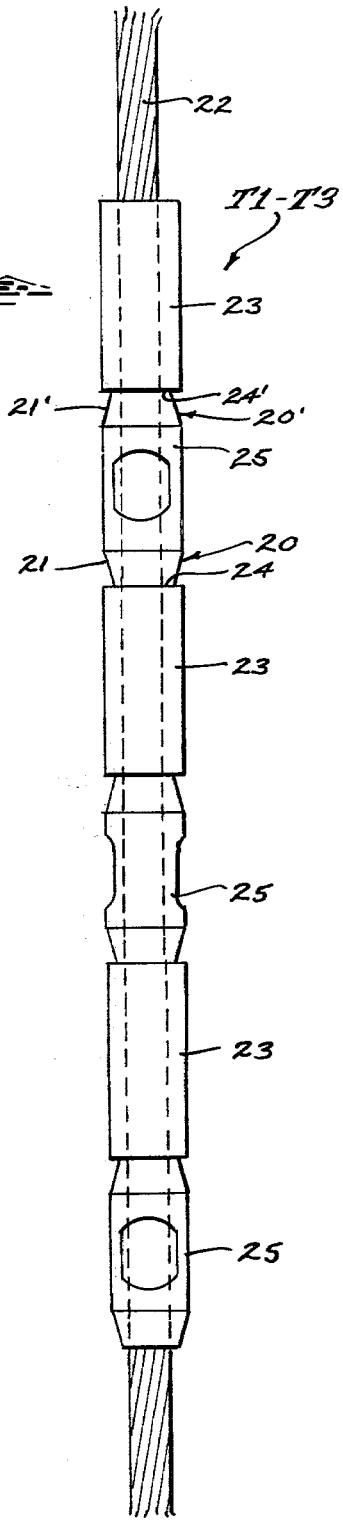
FIGS. 6 and 7 illustrate the secondary tensional support member which characterizes the present invention, FIG. 6 being a longitudinal side view thereof and FIG. 7 being a complementary perspective view of the two spool parts involved therein.
Figure 7:
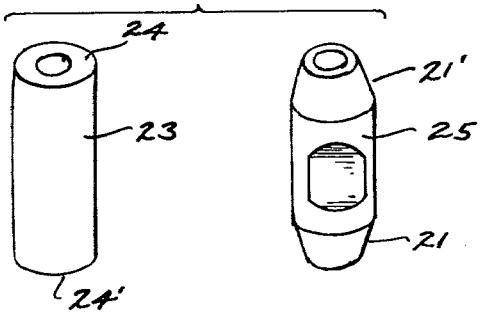

The secondary tension member T1–T3 is a shouldered rod that extends coextensively between the bottom foot and top head of the column leg C1–C3, at the exterior thereof. There is at least one and preferably a multiplicity of secondary suspension members T1–T3 associated with each column leg, for example three or four, or more, secondary suspension members spaced equidistant around the column leg and depending from the periphery of the load bearing header 15. In its basic form the member T–T3 is grooved with upwardly faced shoulders at evenly spaced elevation positions. Each groove 20 has an upwardly disposed normal face and an outwardly and upwardly divergent cone 21, said grooves being alike and evenly spaced. Whereas the basic form of secondary tension member is stepped for forceably receiving downward pressure only, the member T1–T3 is shown as double acting, in which case it is provided with downwardly faced shoulders intermediate said upwardly faced shoulders. Each groove 20' and cone 21' is the same as the groove 20 and cone 21 above described, but faced for forceable upward application of pressure. In the preferred form shown in FIGS. 6 and 7 the tension member T1–T3 is comprised of spools swaged onto a cable 22, the spools being of two characteristic configurations that provide for flexibility that facilitates handling. There is a right cylinder spool 23 that provides the shoulders 24 and 24' at its opposite ends; and there is a double ended bullet-shaped spool 25 that provides the cones 21 and 21'. It will be seen that the components of this secondary tension member are conducive to mass production and shipment coiled in an assembled condition.

Figure 12:
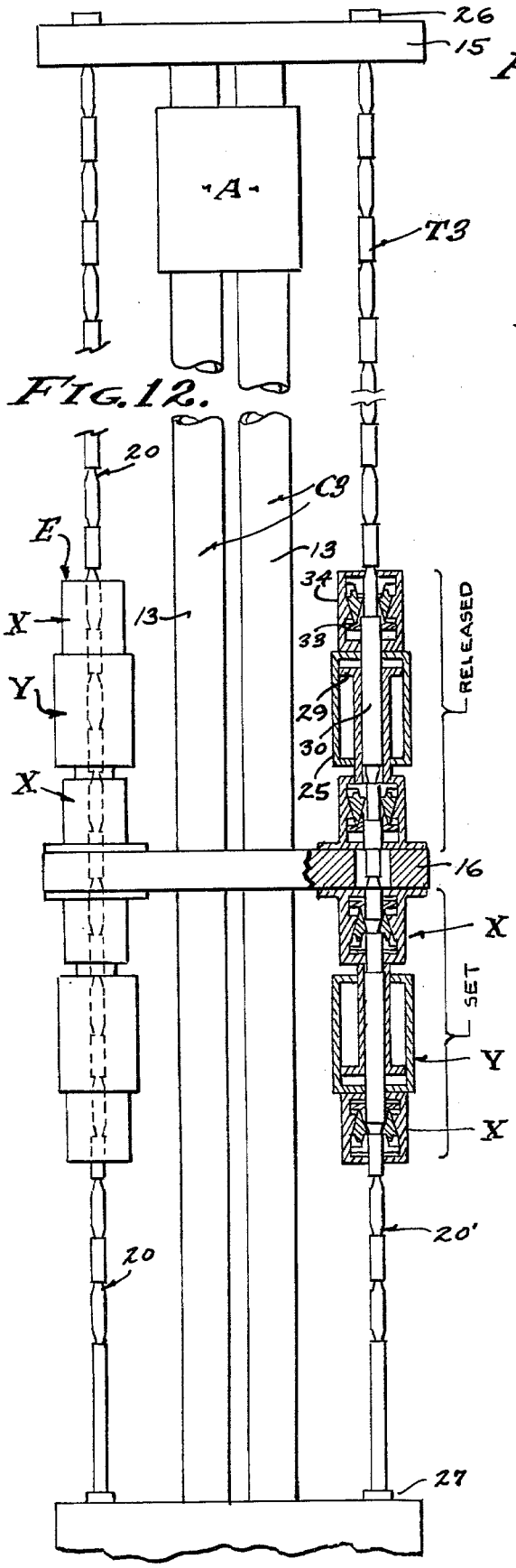
FIG. 12 is an enlarged elevation of the primary column and associated secondary tensioned support member, together with the hydraulic elevating means shown both set and released.
Figure 13:
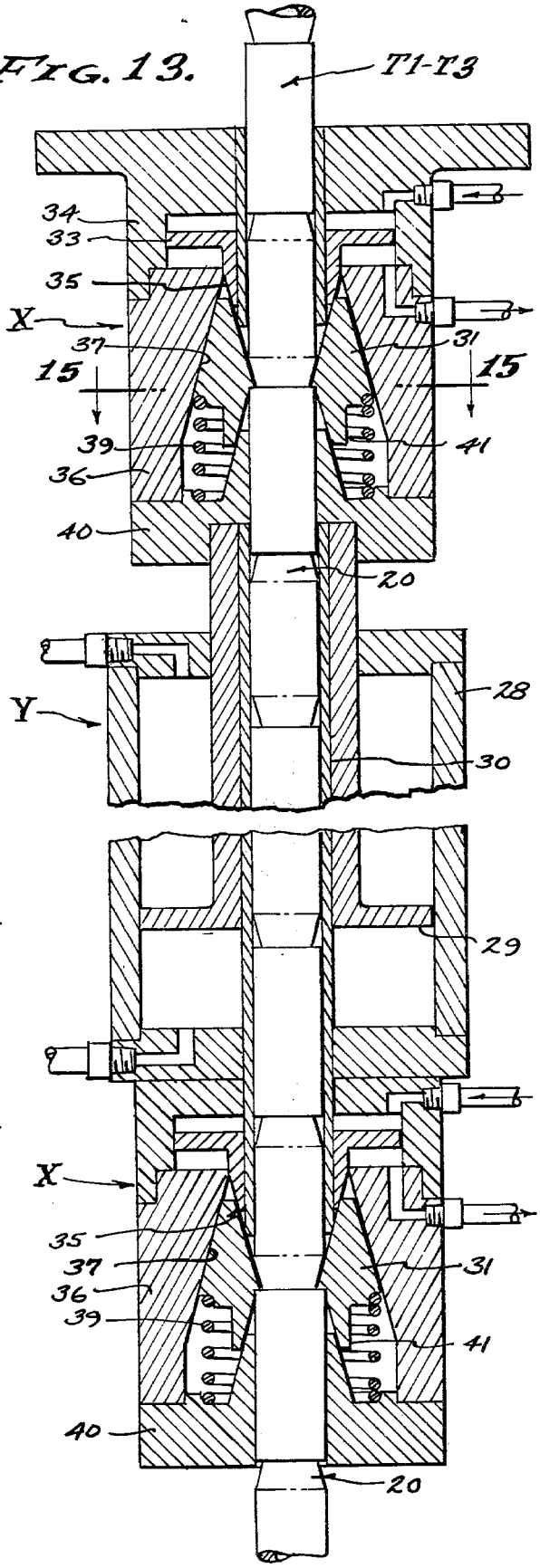
FIG. 13 is an enlarged detailed view of the upwardly operable elevating means, shown in the set condition.

The elevating means E is best illustrated in FIGS. 12 and 13 and is provided to apply lifting force, and also to apply depressing force in its double acting form shown herein. In carrying out this invention, the above described secondary tension member T1–T3 passes by or through the lit ring 16 and is anchored to the load bearing header 15 at 26 and to the foot of the column at 27. The length or height of member T1–T3 permits upward extension of the cylinder-piston means of translator means A, by being tensioned between anchors 26 and 27. In accordance with this invention, the elevating means E is engaged over and operates vertically along the secondary tension member T1–T3, and it involves generally, a pair of alternately engageable and relatively reciprocable clamp means X and a force means Y shifting said clamp means relative to the tension member as related to the load bearing header 15. The clamp means X are like hydro-mechanical devices through which the rod-shaped tension member operates to be incrementally engaged thereby. One of said clamp means X is attached to the load bearing header 15, and the force means Y operates in correlation therewith over the rod-shaped tension member to carry the other clamp means X. The means X and Y are characteristically of cylinder form surrounding the cable 22 and spools 23 and 25 of member T1–T3, with annuli that accommodate the working mechanisms thereof. A feature of the means X and Y combination is the vertical extensibility and retractibility thereof.

There are upper and lower clamp means X, one attached to the ring 16 and carrying one moveable member of the force means Y; and the other free to be extended and retracted and carrying the other moveable member of the force means Y. Accordingly, the force means Y is a hydraulically operated means, comprised of a cylinder 28 carried by one means X and a piston 29 carried by the other means X. A central tubular body 30 extends through the cylinder and piston assembly of means Y, forming and annulus in which the piston 29 operates. The stroke of means Y equals or is slightly greater than the incremental distance between shoulders 24(24'), having a double or compound action so as to be forceably operated in both directions, to extend and to retract.

The clamp means X, in each instance, is comprised of a cylinder body in which segmented jaw members 31 are axially and radially shiftable into and out of engagement with the shoulder 24 (24') and adjacent cone 21 (21'). As shown, the inner diameter is divergent interior cone angularly disposed in conformity to the angularity of cone 21 (21') and projected beyond the outer diameter of the tension member T1–T3. Hydraulic actuating means 32 is provided in the form of an annular piston 33 operable over the tubular body 30 and within a cylinder 34, and with a mandrel 35 having a coneshaped nose angularly compatable with the inner diameter of the segmented clamp member or jaws 31 to separate them when axially depressed into engagement therewith. A refinement is the guiding capability of the clamp body 36 which has an oppositely divergent inner bore 37 that guides the clamp members or jaws axially as they move outwardly. As shown, the clamp jaws 31 are biased axially by a spring 39 and inwardly to engage the shoulder 24 (24'), and the spring seat is a plate 40 that also guides a complementary part 41 of the clamp jaw 31. As shown in FIG. 13 of the drawings, members 31 are both engaged and the force means retracted, and as shown in FIG. 12 one is disengaged or released and the force means extended.

In accordance with this invention, there are upper and lower pairs of clamp means X, and as shown the lower pair is operable to lift or drive upwardly in increments, while the upper pair is operable to depress or drive downwardly in increments. Accordingly, the platform P1–P3 is driven both upwardly and downwardly and captured in both of said incremental positions, for stability. The hydraulic actuation of the clamp means X is compound as is the force means Y, and all of which is under control of suitable valves from the hydraulic pressure source 19.

Figure 3:
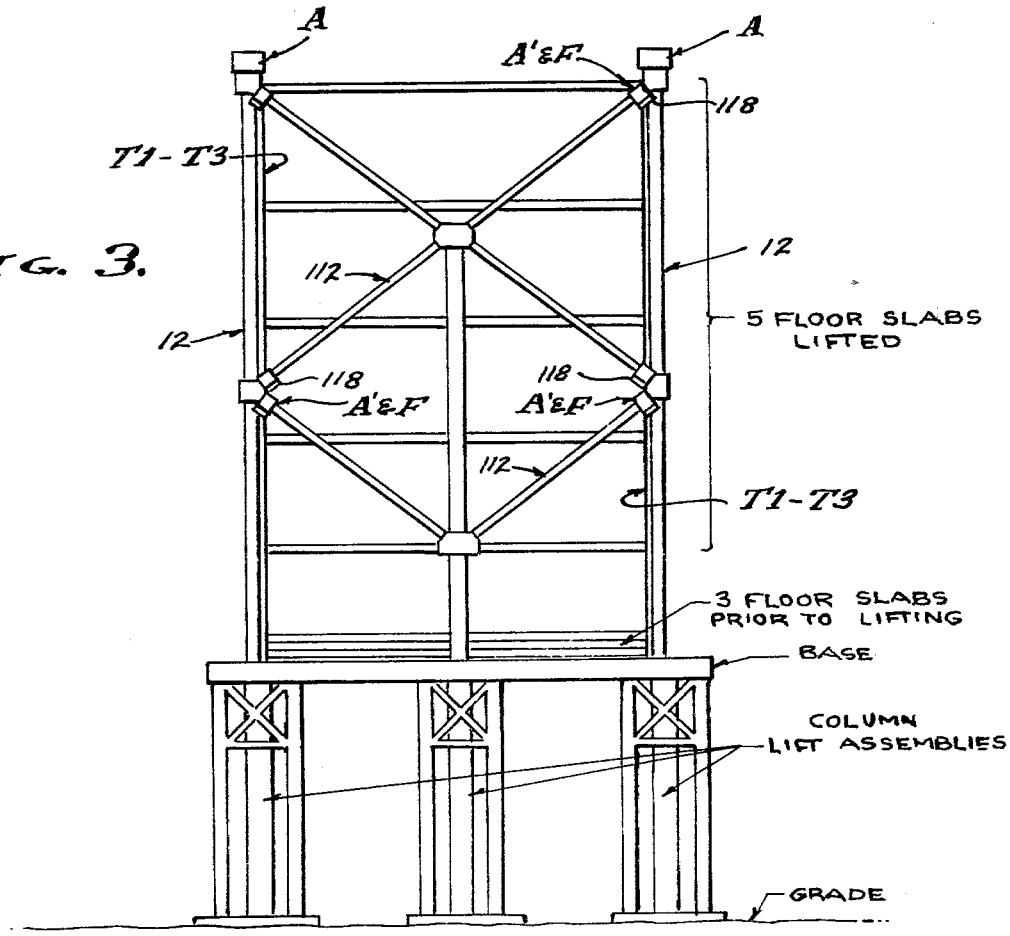
FIG. 3 is a side elevation of a building structure embodying the aforesaid prestressed features and prestressed trusses of the present invention.
Figure 4:
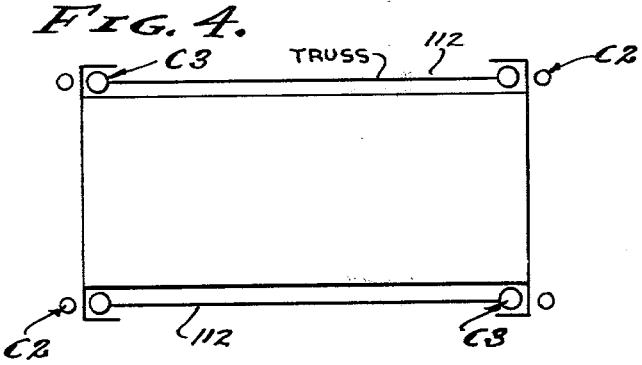
FIGS. 4 and 5 are plan sections taken as indicated by lines 4—4 and 5—5 on FIG. 1 and showing the alternate positions of the cross-trusses.
Figure 5:
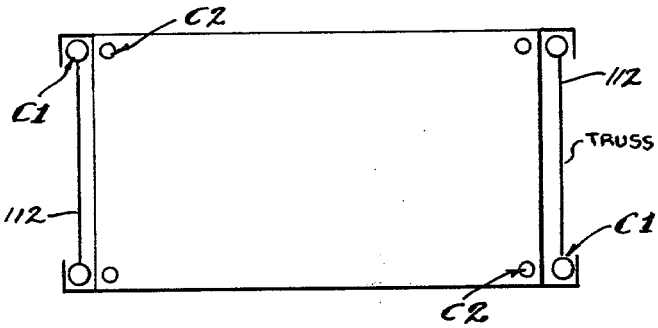

From the foregoing it will be seen that internally prestressed columns are adapted to be employed in prefabricated structures and erected temporarily or permanently on-site where said stressing is applied commensurate with load forces. It is the cooperative functions of the elevating means, corrector means and hydro-pneumatic spring and damping means in the flexible combination of column, platform and truss which is most practical in exploration platforms as depicted herein. Accordingly, an off-shore structure is shown wherein the rig is floated to the site of erection by means of the barge configuration of platform P3 that transports the remaining platform or platforms and trusses, as the case may be. The elevating means E is operated as hereinabove described to lift one platform above the other and through translator means A to prestress the columns C1–C3 commensurate with the loads applied. The trusses 112 are installed as indicated in FIGS. 3, 4, and 5, for example staggered trusses assembled into opposite sides of the structure as it is erected, and at alternate levels thereof. Noting that the joinder of structural members is dynamically applied by the translation means A and A', the structure is inherently flexible and its stability subject to the introduction and control over the volume and transfer of liquids by said translator means. Positioning of the column and truss ends as they are related to the platforms is primarily by means of the corrector F, as to column height and truss length; and secondarily by means of the hydro-pneumatic shock and damping means which substantially reduces strain and inertial loads, thereby practically eliminating fatigue as the stresses applied are absorbed in the fluid dynamics as they are hereinabove described.

Having described only the typical preferred form and applications of my invention, I do not wish to be limited or restricted to the specific details herein set forth, but wish to reserve to myself any modifications or variations that may appear to those skilled in the art as set forth within the limits of the following claim:

I claim:

1. A self erecting column supported platform and load compensating system therefor, and including;

a vertically disposed primary structural column means adapted to be strengthened with the application of internal fluid pressure thereto, a secondary structural member depending parallel to the primary structural column means from a load bearing header, a platform of substantial weight to be elevated along said column, an elevating means supporting the platform and to transport and thereby elevate the platform relative to said column means by supporting the same along said secondary structural member, and a translator means to convert the weight force of the platform into fluid pressure applied internally of said column means to tension and thereby strengthen the same, and comprising means carrying the weight of the platform through the load bearing header of the elevating means support with the secondary structural member suspended therebetween and transfering fluid at commensurate pressure into said primary structural column means.

2. The self erecting column supported and load compensating column and platform system as set forth in claim 1, wherein the vertically disposed primary structural column means comprises at least one tubular leg closed at the bottom end and open to said translator means at the top end thereof.

3. The self erecting column supported and load compensating column and platform system as set forth in claim 1, wherein the vertically disposed primary structural column means comprises a multiplicity of tubular legs constrained within a surrounding casing and thereby bundled together and closed at their bottom ends and open at their top ends into a manifold chamber in communication with said translator means.

4. The self erecting column supported and load compensating column and platform system as set forth in claim 1, wherein the secondary structural member is a flexible member depending from said load bearing header.

5. The self erecting column supported and load compensating column and platform system as set forth in claim 1, wherein the secondary structural member is a flexible member anchored to and extending between said load bearing header and the bottom end of the column means.

6. The self erecting column supported and load compensating column and platform system as set forth in claim 1, wherein the secondary structural member is a load bearing member depending from said load bearing header, and wherein the platform is free to swing on said secondary structural member relative to the column means.

7. The self erecting column supported and load compensating column and platform system as set forth in claim 1, wherein the secondary structural member is a flexible member comprised of a cable with incrementally spaced upwardly disposed shoulders formed by spools positioned over the cable, and wherein the elevating means comprises, clamp means having downwardly faced jaws complementary with and to disengageably seat against said shoulders, and force means to operate the jaws.

8. The self erecting column supported and load compensating column and platform system as set forth in claim 1, wherein the secondary structural member is a flexible member comprised of a cable with incrementally spaced upwardly and downwardly disposed shoulders formed by spools spaced by bullet-shaped separators, said spools and separators being positioned over the cable and wherein the elevating means comprises two pairs of clamp means, one clamp means having downwardly faced jaws complementary with and to engage said upwardly disposed shoulders, and the other clamp means having upwardly faced jaws complementary with and to engage said downwardly disposed shoulders.

9. The self erecting column supported and load compensating column and platform system as set forth in claim 1, wherein the vertically disposed primary structural column means comprises a multiplicity of tubular legs constrained within a surrounding casing and thereby bundled together and closed at their bottom ends and open at their top ends into a manifold chamber in communication with said translator means, wherein the secondary structural member is a flexible member anchored to and extending between said load bearing header and the bottom end of the column means, and wherein the platform is free to swing on said secondary structural member relative to the column means.

10. The self erecting column supported and load compensating column and platform system as set forth in claim 1, wherein the elevating means comprises a pair of relatively reciprocable clamp means alternately engageable with said secondary structural member, and force means to extend and retract the pair of clamp means relative to each other for incremental movement of the platform along said secondary structural member.

11. The self erecting column supported and load compensating column and platform system as set forth in claim 1, wherein the secondary structural member is of stepped rod configuration with incrementally spaced upwardly disposed shoulders, and wherein the elevating means comprises a pair of relatively reciprocable clamp means having downwardly faced jaws complementary with and to engage said shoulders, and force means to alternately extend and retract said jaws of each clamp means and simultaneously extend and retract the pair of clamp means relative to each other for incremental movement of the platform along said secondary structural member.

12. The self erecting column supported and load compensating column and platform system as set forth in claim 1, wherein the secondary structural member is of stepped rod configuration with incrementally spaced shoulders alternately faced upward and downward therealong, and wherein the elevating means comprises two pairs of relatively reciprocable clamp means, one clamp means having downwardly faced jaws complementary with and to engage said upwardly faced shoulders, and the other clamp means having upwardly faced jaws complementary with and to engage said downwardly faced shoulders, and force means independently operating each pair of clamp means by extending and retracting said jaws thereof and simultaneously extending and retracting the pairs of clamp means relative to each other for incremental movement of the platform along said secondary structural member.

13. The self erecting column supported and load compensating column and platform system as set forth in claim 1, wherein the translator means comprises a hydraulic piston and cylinder means operated by said load bearing header to apply liquid therein under pressure to said primary column means commensurate with the weight force imposed by the platform suspended through said secondary structural member.

14. The self erecting column supported and load compensating column and platform system as set forth in claim 1, wherein the translator means comprises, a vertically disposed upwardly open cylinder at the top end of the primary structural column and in liquid communication therewith, and a piston depressible into the cylinder by said load bearing header to apply liquid therein under pressure to said primary column means commensurate with the weight force imposed by the platform suspended through said secondary structural member.

15. The self erecting column supported and load compensating column and platform system as set forth in claim 1, wherein the vertically disposed primary structural column means comprises a multiplicity of tubular legs constrained within a surrounding casing and thereby bundled together and closed at their bottom ends and open at their top ends into a manifold chamber in communication with said translator means, wherein the secondary structural member is of stepped rod configuration with incrementally spaced shoulders alternately faced upward and downward therealong, wherein the elevating means comprises two pairs of relatively reciprocable clamp means, one clamp means having downwardly faced jaws complementary with and to engage said upwardly faced shoulders, and the other clamp means having upwardly faced jaws complementary with and to engage said downwardly faced shoulders, and force means independently operating each pair of clamp means by extending and retracting said jaws thereof and simultaneously extending and retracting the pairs of clamp means relative to each other for incremental movement of the platform along said secondary structural member, and wherein the translator means comprises, a vertically disposed upwardly open cylinder at the top end of the primary structural column and in liquid communication therewith, and a piston depressible into the cylinder by said load bearing header to apply liquid therein under pressure to said primary column means commensurate with the weight force imposed by the platform suspended through said secondary structural member.

16. The self erecting column supported and load compensating column and platform system as set forth in claim 1, wherein diagonally disposed secondary truss means adapted to be strengthened with the application of internal pressure thereto is connected to extend laterally of said primary column means, and translator means at said connection to convert interconnection force between the truss and column means into fluid pressure applied internally of said truss means to tension and thereby strengthen the same and comprising means opposing movement of the truss means and column means and transfering fluid at commensurate pressure into said secondary truss means.

17. The self erecting column supported and load compensating column and platform system as set forth in claim 1, wherein diagonally disposed secondary truss means adapted to be strengthened with the application of internal pressure thereto is connected to extend laterally of said primary column means, and translator means at said connection to convert interconnection force between the truss and column means into fluid pressure applied internally of said truss means to tension and thereby strengthen the same and comprising means opposing movement of the truss means and column means and transfering fluid at commensurate pressure into said secondary truss means, and wherein the secondary truss means comprises at least one tubular leg closed at one end and open to said translator therefor at the connected end.

18. The self erecting column supported and load compensating column and platform system as set forth in claim 1, wherein diagonally disposed secondary truss means adapted to be strengthened with the application of internal pressure thereto is connected to extend laterally of said primary column means, and translator means at said connection to convert interconnection force between the truss and column means into fluid pressure applied internally of said truss means to tension and thereby strengthen the same and comprising means opposing movement of the truss means and column means and transfering fluid at commensurate pressure into said secondary truss means, and wherein the secondary truss means comprises a multiplicity of tubular legs constrained within a surrounding casing and thereby bundled together and closed at one end and open by means of a manifold into said translator therefor at the connected end.

19. The self erecting column supported and load compensating column and platform system as set forth in any one of claims 1 through 18, wherein corrector means is responsive to the relative vertical positioning of the load bearing header and column means and comprises a pressure source and valve means charging and exhausting fluid into said column means so as to maintain vertical position of said load bearing header and supported platform within tolerable limits.

20. A column supported platform and load compensating and positioning system therefor, and including;

- a vertically disposed primary structural column means adapted to be strengthened with the application of internal fluid pressure thereto,
- a secondary structural member depending from a load bearing header and parallel to the primary structural column means,
- a platform of substantial weight supported by the secondary structural member to move with the load bearing header relative to the column means,
- a translator means to convert the weight force of the platform into fluid pressure applied internally of said column means to tension and thereby strengthen the same, and comprising means carrying the weight of the platform through the load bearing header moveable vertically relative to the column means and transfering fluid at commensurate pressure into said column means, and corrector means responsive to the relative vertical positioning of the load bearing header and the column means and with a pressure source and valve means charging and exhausting fluid into said column means so as to maintain vertical position of said load bearing header and supported platform within tolerable limits.

21. The column supported and load compensating and positioning system as set forth in claim 20, wherein the corrector means comprises a fluid pressure source at least as great as the operating pressure within said primary structural column means.

22. The column supported and load compensating and positioning system as set forth in claim 20, wherein the corrector means comprises a three-way valve means with a supply line from said pressure source, a pressure line in communication with the interior of said primary means, and with an exhaust line.

23. The column supported and load compensating and positioning system as set forth in claim 20, wherein the corrector means comprises a three-way valve means with a supply line open from said pressure source when the load bearing header is depressed relative to the column means, and an exhaust line open from the column means when the load bearing header is elevated relative to the column means.

24. The column supported and load compensating and positioning system as set forth in claim 20, wherein the corrector means comprises a fluid pressure source at least as great as the operating pressure within said primary structural column means, and a three-way valve means with a supply line open from said pressure source when the load bearing header is depressed relative to the column means, and an exhaust line open from the column means when the load bearing header is elevated relative to the column means.

25. A column supported platform and load compensating and cushioning system therefor, and including;

- a vertically disposed primary structural column means adapted to be strengthened with the application of internal fluid pressure thereto,
- a secondary structural member depending from a load bearing header and parallel to the primary column means,
- a platform of substantial weight supported by the secondary structural member to move with the load bearing header relative to the column means,
- a translator means to convert the weight force of the platform into fluid pressure applied internally of said column means to tension and thereby strengthen the same, and comprising means carrying the weight of the platform through the load bearing header moveable vertically relative to the column means and transfering fluid at commensurate pressure into said column means,
- and shock damping means responsive to the relative vertical movement of the load bearing header and the column means and comprising a gas charge at a normal pressure commensurate with the load and opposed to the fluid in said column means and operating as an elastic medium cushion.

26. The column supported and load compensating and cushioning system as set forth in claim 25, wherein the shock damping means comprises an accumulator charged with said gas at normal pressure and with fluid in open communication with and to oppose the fluid in said column means.

27. The column supported and load compensating and cushioning system as set forth in claim 25, wherein the shock damping means comprises and accumulator charged with said gas at normal pressure and with fluid in open communication into the column means through flow controlling orifices.

28. The column supported and load compensating and cushioning system as set forth in claim 25, wherein the shock damping means comprises an accumulator with a piston separating fluid in open communication into the column means from said gas charge at normal pressure.

29. The column supported and load compensating and cushioning system as set forth in claim 25, wherein the shock damping means comprises an accumulator with a piston separating fluid in open communication into the column means from said gas charge at normal pressure, and with flow controlling valve means in said open communication into the column means.

30. The self erecting column supported and load compensating and cushioning system as set forth in any one of claims 1 through 18, wherein cushioning means is responsive to the relative vertical movement of the load bearing header and the column means and comprises a gas charge at a normal pressure commensurate with the load and opposed to the fluid in said column means and operating as an elastic medium cushion.

31. The self erecting column supported and load compensating positioning and cushioning system therefor as set forth in any one of claims 1 through 18, wherein corrector means is responsive to the relative vertical positioning of the load bearing header and column means and comprises a pressure source and valve means charging and exhausting fluid into said column means so as to maintain vertical position of said load bearing header and supported platform within tolerable limits, and wherein cushioning means is responsive to the relative vertical movement of the load bearing header and the column means and comprises a gas charge at a normal pressure commensurate with the load and opposed to the fluid in said column means and operating as an elastic medium cushion.

* * * * *